US006609972B2

(12) United States Patent
Seelig et al.

(10) Patent No.: US 6,609,972 B2
(45) Date of Patent: Aug. 26, 2003

(54) METHOD AND DEVICE FOR PLAYING A GAME WITH PLAYER SELECTABLE DISPLAY DEVICES

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 0 days.

(21) Appl. No.: 09/927,245

(22) Filed: Aug. 10, 2001

(65) Prior Publication Data

US 2002/0094861 A1 Jul. 18, 2002

Related U.S. Application Data

(60) Provisional application No. 60/241,385, filed on Oct. 17, 2000.

(51) Int. Cl.[7] ..... A63F 9/24

(52) U.S. Cl. ..... 463/16; 463/20; 273/138.1

(58) Field of Search ..... 463/1, 9, 12–13, 463/16–22, 25–27, 30–31, 37; 273/138.1, 139, 141 R, 142 R, 142 H, 142 HA, 143 R

(56) References Cited

U.S. PATENT DOCUMENTS

| | | | | | |
|---|---|---|---|---|---|
| 5,788,573 | A | * | 8/1998 | Baerlocher et al. | 463/16 |
| 5,848,932 | A | | 12/1998 | Adams | |
| 6,179,710 | B1 | * | 1/2001 | Sawyer et al. | 463/16 |
| 6,309,300 | B1 | * | 10/2001 | Glavich | 463/26 |
| 6,336,863 | B1 | * | 1/2002 | Baerlocher et al. | 463/27 |
| 6,439,995 | B1 | * | 8/2002 | Hughs-Baird et al. | 463/20 |

* cited by examiner

*Primary Examiner*—Kim Nguyen
(74) *Attorney, Agent, or Firm*—Ian F. Burns

(57) ABSTRACT

The invention provides a highly attractive and entertaining device for displaying bonus prize objects. In addition, it provides players with the ability to participate in the selection of a bonus prize. The invention provides a gaming device having a gaming apparatus and a bonus display. The bonus display indicates at least one of a plurality of bonuses using a mechanical bonus indicator. Each position of the indicator includes at least two bonus prizes, which may be selected by the player.

25 Claims, 2 Drawing Sheets

METHOD AND DEVICE FOR PLAYING A GAME WITH PLAYER SELECTABLE DISPLAY DEVICES

This application claims priority to U.S. provisional patent application serial No. 60/241,385, filed Oct. 17, 2000.

BACKGROUND OF THE INVENTION

1. Field of Invention

The present invention relates to gaming devices and, more particularly, to a gaming device and method having a moving bonus indicator.

2. Description of Related Art

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonus prizes in addition to prizes that are awarded in the primary game. A bonus prize can be defined as an additional prize that is awarded to the player when a predefined event occurs. An example of a bonus game can be found in U.S. Pat. No. 5,848,932 issued to Adams, which is hereby incorporated by reference. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

Generally, bonus prizes are given in such games in order to increase the excitement and enjoyment experienced by players, which attracts more players to the game and encourages players to play longer. When this occurs, the gaming devices tend to be more commercially successful relative to other gaming devices. A shortcoming of present bonus games is that they do not sufficiently allow players to participate in awarding of bonus prizes.

Display Devices

Highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

Display devices tend to be more successful if they utilize moveable physical objects rather than simulations. Although video devices and electronic signs can be used for display devices, players are more attracted to display devices that utilize physical objects. Physical objects can be even more effective display devices if the player is allowed to participate in the operation of the object.

In view of the foregoing, there is a need in the art for a gaming device that provides bonus prizes with a physically movable and attractive bonus display, and allows selection of bonus prizes.

SUMMARY OF INVENTION

1. Advantages of the Invention

An advantage of the present invention is that it provides a highly attractive and entertaining device for displaying bonus prizes.

Another advantage of the present invention is that it allows players to participate in the selection of a bonus prize.

These and other advantages of the present invention may be realized by reference to the remaining portions of the specification, claims, and abstract.

2. Brief Description of the Invention

The present invention provides a gaming device having a gaming apparatus and a bonus display. The gaming device includes a gaming outcome display. The bonus display indicates at least one of a plurality of bonuses using a mechanical bonus indicator. The bonus indicator is linearly movable by a drive mechanism that positions the indicator at one of a plurality of bonus indicating positions. A selector for allowing a user to select between bonus prizes may also be provided.

Also provided is a method of conducting a wagering game of chance. The method includes the step of positioning a mechanical bonus indicator at one of a plurality of physical positions to indicate a bonus set. Each bonus set includes at least two bonus prizes. The method also includes the step of allowing the player to select one of the bonus prizes.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Preferred embodiments of the present invention are shown in the accompanying drawings wherein.

DESCRIPTION OF THE PREFERRED EMBODIMENT

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
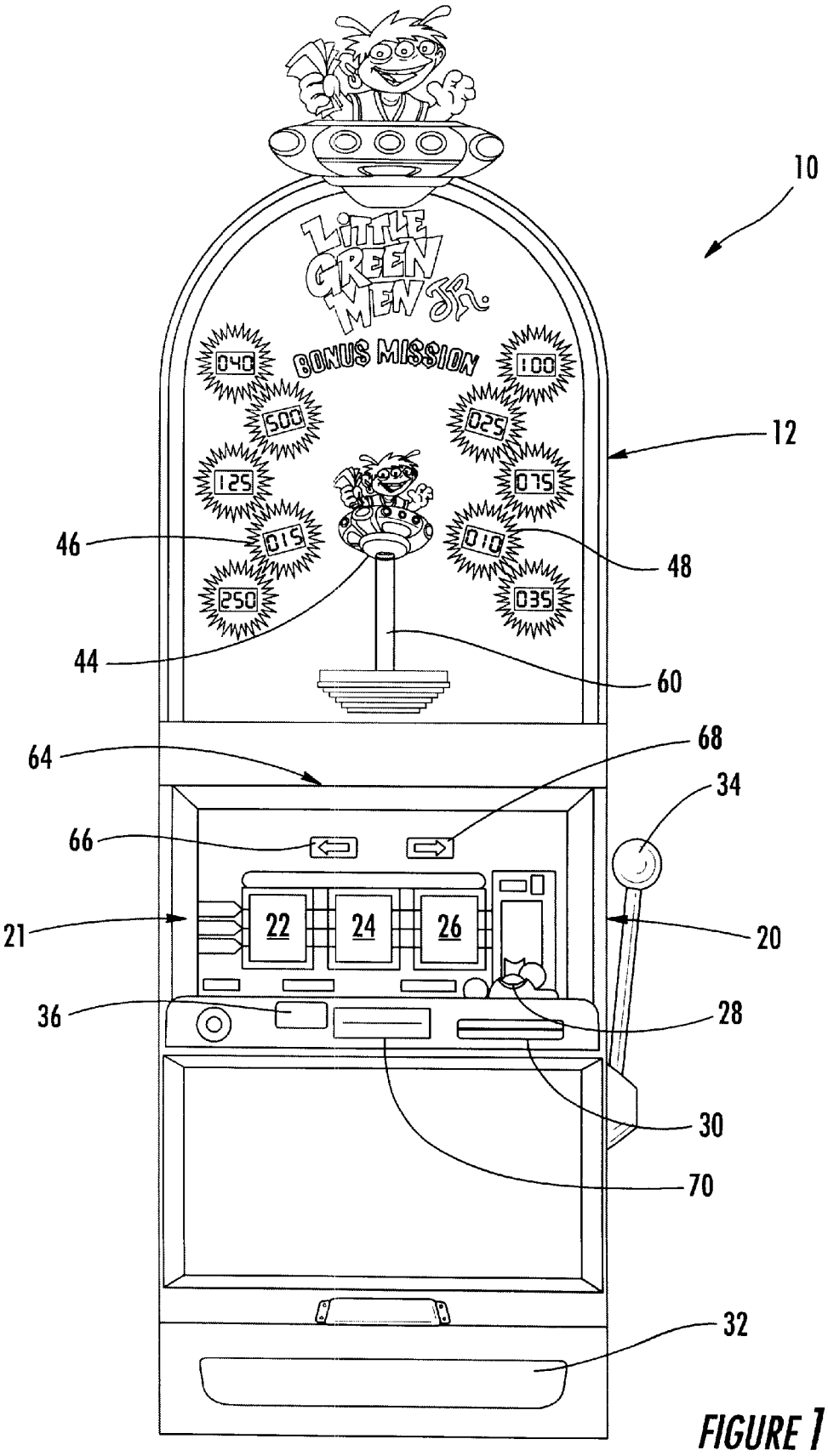
FIG. 1 is substantially a front view of the gaming device of the present invention.

As seen in FIG. 1, the present invention comprises a gaming device, generally indicated by reference number 10.

In one preferred embodiment, gaming device 10 comprises a bonus display 12 and a game apparatus 20.

Game Apparatus

With continuing reference to FIG. 1, game apparatus 20 may be any of a large number of devices that are adapted to allow players to play a game. For example, game apparatus 20 may include a gaming outcome display 21 that utilizes spinning reels 22, 24, 26 or a video display (not shown) to display outcomes of the game. A wager acceptor, such as a coin slot 28 or card reader 30, may also be provided for accepting wagers. In addition, a payout mechanism, such as a coin dispenser 32, may be provided for awarding prizes. A handle 34 and button 36 are provided for activating game apparatus 20 to begin a game. In at least one preferred embodiment, game apparatus 20 may be an S Plus model gaming device manufactured by International Game Technology in Reno, Nev.

Figure 2:
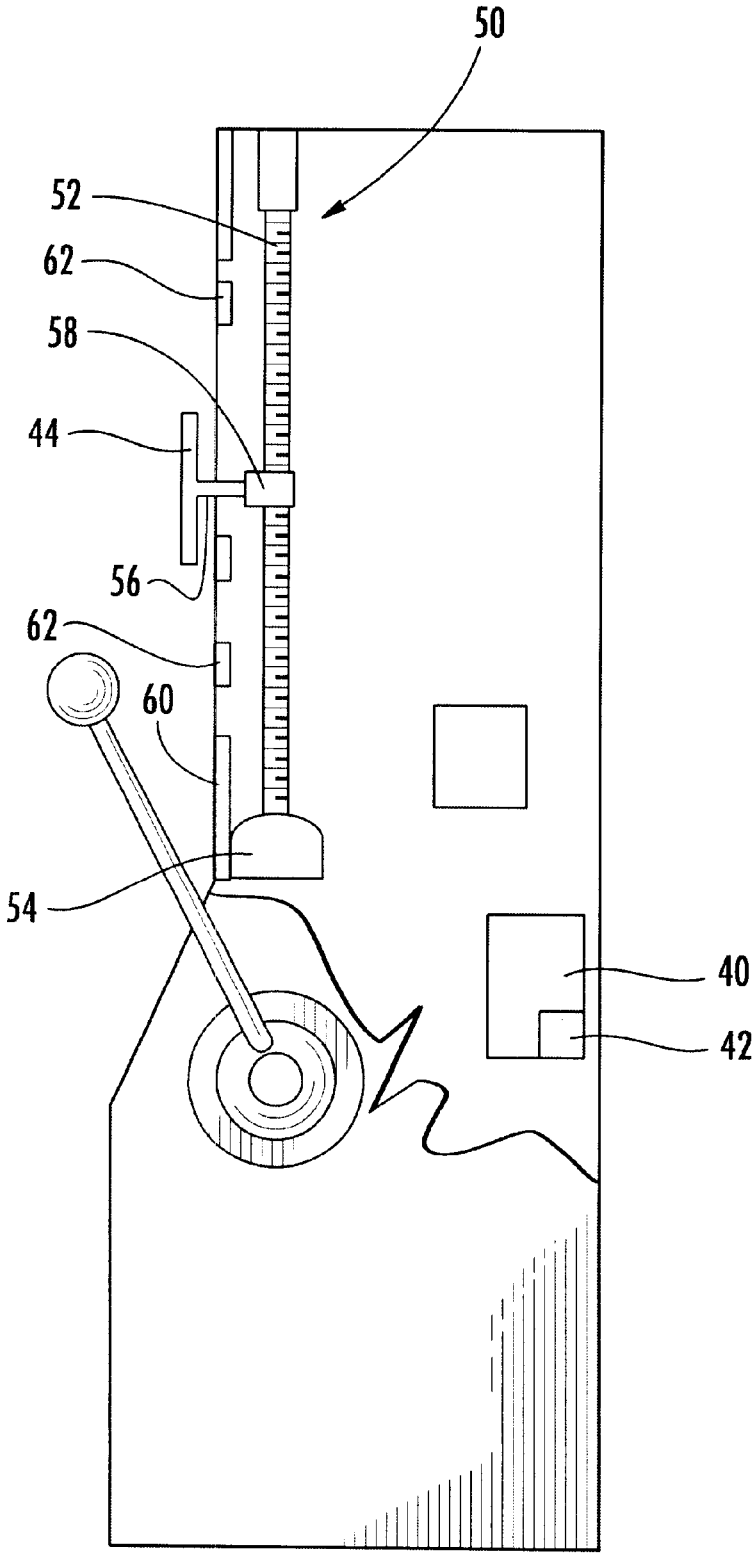
FIG. 2 is substantially a partial cross-sectional view of the gaming device of FIG. 1.

Referring also to FIG. 2, game apparatus 20 is preferably controlled by an electronic controller 40 that utilizes a random number generator 42. Random number generator 42 produces a random or pseudo random number for each game. The outcome of the game may be determined by comparing the random number to a table of outcomes stored in a memory and accessed by controller 40. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham, which are hereby incorporated by reference. Controller 40 causes gaming outcome display 21 (FIG. 1), e.g., spinning reels 22, 24, 26, to show the outcome of the game that corresponds to the outcome of random number generator 42. It is recognized that game apparatus 20 may operate in many other ways and still achieve the objects of the present invention.

Game apparatus 20 may also be capable, via controller 40 or other bonus control mechanism (not shown), of producing a bonus-activating event. This event may be many different types of events. For example, a bonus-activating event may comprise a game outcome such as displaying a particular symbol, e.g., a "bonus" symbol, or combination of symbols, such as three "7" symbols on reels 22, 24, 26. If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Bonus Display

Referring again to FIG. 1, bonus display 12 is adapted to select a bonus prize and display the prize to a player. When bonus display 12 is informed that a bonus-activating event has occurred, bonus display 12 causes indicator 44 to move linearly (in this case vertically) to a selected height. A plurality of stop positions (levels) is provided, and each position indicates one of a plurality of bonus sets. Each bonus set includes at least two bonus prizes, which are displayed adjacent indicator 44. In the example shown, there are five different vertical stop positions, each indicating two bonus prizes, and indicator 44 has stopped at a height that has bonus prize displays 46 and 48. Also in this example, indicator 44 is a space ship with an alien pilot and prize displays 46 and 48 appear to be planets or stars. However, many other shapes and objects may be used for indicator 44 or prize displays 46, 48.

As shown in FIG. 2, indicator 44 is made to move up and down by a drive mechanism 50. The drive mechanism may be a large variety of different devices. For example, as shown in FIG. 2, drive mechanism 50 may be a vertically positioned worm gear 52 that is caused to rotate by a motor 54. Indicator 44 may be attached to worm gear 52 by a bracket 56 that is attached to a nut 58 threaded on worm gear 52. A slot 60 (best shown in FIG. 1) may be provided in the front face of bonus display 12, which allows bracket 56 to pass through the face. Sensors 62 may be provided to allow controller 40, or other bonus control mechanism (not shown), to detect the position of indicator 44. While indicator 44 was shown to move vertically, it may also be moved horizontally, or diagonally or in a non-linear fashion such as in rotating manner.

Once indicator 44 has stopped, the player is then given the opportunity to select one of the prizes indicated. In the exemplary display shown, the user may select either the left bonus prize displayed 46 or the right bonus prize displayed 48. The player may indicate his or her choice by making a selection via a selector that may take a variety of forms. In one preferred embodiment, shown in FIG. 1, a selector 64 includes buttons 66 and 68 that allow the player to select the corresponding prize display. For example, the player would press the left button 66 to select the left bonus prize 46. Alternatively, a touch screen (not shown) may be provided in place of or in addition to buttons 66 and 68. The selector may be any other now known or later developed mechanism for selecting between two items.

Once the player has selected the bonus prize, bonus display 12 would display the bonus prize won by the player. For instance, the selected bonus prize 46, 48 may blink or have some other indication of selection.

In one preferred embodiment, the bonus prizes are randomly generated. The controller generates a random number for each bonus prize to be awarded, and then compares the random number to a pay table similar to that described for game apparatus 20 or as described in U.S. Pat. No. 5,823,874, issued to Adams, which is hereby incorporated by reference. A simple pay table may appear as follows:

| Random Number | Amount Paid |
|---|---|
| 0.00 to 0.50 | $1.00 |
| 0.51 to 0.75 | $5.00 |
| 0.76 to 0.95 | ×2 |
| 0.96 to 1.00 | $1,000.00 |

For example, if random number generator 42 produced 0.65, $5.00 would be awarded to the player. If the random number generator produced 0.80, the player would receive a multiplier of 2. The multiplier multiplies some amount produced by game apparatus 20. Gaming apparatus 20, for instance, may award $20 and the multiplier would multiply this by two, awarding the player $40.

The bonus selection process may be repeated to accumulate several bonus prize selections that are added to form the award to the game player. The bonus selection process can be repeated a pre-determined number of times. For example, the bonus game could be repeated three times to accumulate an award.

The present invention is not limited to the example pay table shown. Furthermore, different kinds of bonus prizes, besides monetary prizes, may be awarded. For example, the bonus prizes may be goods, services, or additional games.

Once controller 40 (FIG. 2) determines the bonus prizes to be awarded, controller 40 causes the appropriate bonus prize displays 46, 48 to display the prizes for selection by the user. Bonus prize displays 46, 48 may be a large number of devices that are well known in the art. For example, the displays may be an LED meter.

Other effects may also be presented, such as pre-recorded sound from speakers. If the actual bonus prize is money, the amount of the bonus prize may be added to the player's credit meter (not shown) or the bonus prize may be dispensed from dispenser 70 or coin dispenser 32.

Many other methods may be used to operate the present invention. For example, the player may be allowed to select the vertical height of indicator 44. Additional buttons or a touch screen may enable this function.

Another embodiment of the invention includes a method of conducting a wagering game of chance comprising the steps of: providing a player with an opportunity to place a wager; displaying a gaming outcome at a gaming outcome display; determining an award of a bonus set including at least two bonus prizes; positioning a mechanical bonus indicator at one of a plurality of physical positions to indicate the bonus set; and allowing the player to select one of the bonus prizes. The step of positioning the mechanical bonus indicator may include linearly moving the bonus indicator to one of a plurality of physical positions.

CONCLUSION

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A gaming device, the gaming device comprising:

(A) at least one game apparatus, the game apparatus being configured to allow a player to place a wager and play a game, the game apparatus being further adapted to produce a bonus-activating event;

(B) at least one bonus display, the bonus display comprising:

(a) a plurality of bonus prize displays, each bonus prize display being adapted to selectively display a bonus prize, the bonus prize displays being grouped in a plurality of sets, each set comprising a plurality of bonus prize displays;

(b) at least one physical moveable indicator, the indicator being adapted to move relative to the sets of bonus prize displays and selectively indicate at least one of the sets of bonus prize displays;

(C) at least one selector, the selector being adapted to allow the player to indicate one bonus prize display from the set of bonus prize displays indicated by the indicator;

(D) at least one controller in communication with the game apparatus, the bonus display, and the selector, the controller being configured to:

(a) detect a bonus activating event;

(b) select a set of bonus prize displays;

(c) cause the indicator to indicate the selected set of bonus prize displays;

(d) detect the bonus prize display selected by the player;

(e) determine a bonus prize; and (f) cause the bonus prize display selected by the player to display the bonus prize.

2. The gaming device of claim 1, wherein the controller is further adapted to cause at least one bonus prize display that was not selected by the player to display a second bonus prize.

3. The gaming device of claim 1, wherein the sets of bonus prize displays are in a linear arrangement and the physical moveable indicator moves linearly.

4. The gaming device of claim 1, wherein the sets of bonus prize displays are in a vertical arrangement.

5. The gaming device of claim 1, wherein the sets of bonus prize displays are in a horizontal arrangement.

6. The gaming device of claim 1, wherein the sets of bonus prize displays are in a non-linear arrangement and the physical moveable indicator moves non-linearly.

7. The gaming device of claim 1, wherein the controller is further configured to cause the bonus prize display selected by the player to display the bonus prize after the player has selected the bonus prize display.

8. The gaming device of claim 1, further comprising a drive mechanism attached to the indicator, the controller being further configured to cause the drive mechanism to change the physical position of the indicator.

9. The gaming device of claim 8, wherein the drive mechanism comprises a worm gear and a motor, the indicator being rotatably attached to the worm gear and the motor being coupled to the worm gear, wherein the motor is configured to cause the worm gear to rotate thereby causing the indicator to move along a longitudinal axis of the worm gear.

10. A gaming device, the gaming device comprising:

(A) at least one game apparatus, the game apparatus being configured to allow a player to place a wager and play a game;

(B) a plurality of bonus prize displays, each bonus prize display being configured to display a bonus prize;

(C) at least one physical moveable indicator, the physical moveable indicator being configured to indicate at least two bonus prize displays and less than all of the bonus prize displays;

(D) at least one selector, the selector being adapted to allow the player to indicate one of the bonus prize displays from the at least two bonus prize displays indicated by the physical moveable indicator;

(E) at least one controller in communication with the game apparatus, the plurality of bonus prize displays, and the selector, the controller being configured to:

(a) detect a bonus-activating event;

(b) select the at least two bonus prize displays to be indicated by the physical moveable indicator;

(c) cause the physical moveable indicator to indicate the at least two bonus prize displays;

(d) detect the bonus prize display selected by the player;

(e) determine a bonus prize; and (f) cause the bonus prize display selected by the player to display the bonus prize.

11. The gaming device of claim 10, wherein the controller is further adapted to cause at least one bonus prize display that was not selected by the player to display a second bonus prize.

12. The gaming device of claim 10, wherein the at least two bonus prize displays are in a linear arrangement and the physical moveable indicator moves linearly.

13. The gaming device of claim 10, wherein the at least two bonus prize displays are in a vertical arrangement.

14. The gaming device of claim 10, wherein the at least two bonus prize displays are in a non-linear arrangement and the physical moveable indicator moves non-linerarly.

15. The gaming device of claim 10, wherein the controller is further configured to cause the bonus prize display selected by the player to display the bonus prize after the player has selected the bonus prize display.

16. The gaming device of claim 10, further comprising a drive mechanism attached to the indicator and in communication with the controller, the controller being further configured to cause the drive mechanism to change the physical position of the indicator.

17. The gaming device of claim 16, wherein the drive mechanism comprises a worm gear and a motor, the indicator being coupled to the worm gear and the motor being coupled to the worm gear, wherein the motor is configured to cause the worm gear to rotate thereby causing the indicator to move relative to the bonus prize displays.

18. A method of operating a gaming device, comprising:

(A) providing a plurality of bonus prize displays, each bonus prize display being configured to display a bonus prize, the plurality of bonus prize displays being grouped in a plurality of sets, each set having at least two bonus prize displays and having less than all of the bonus prize displays;

(B) allowing a player to place a wager and play a game;

(C) producing a bonus activating event;

(D) selecting a set of bonus prize displays;

(E) indicating at least one set of the bonus prize displays using a physical moveable indicator;

(F) allowing the player to select at least one bonus prize display of the indicated set of bonus prize displays;

(G) determining a bonus prize; and (H) displaying the bonus prize in the bonus prize display selected by the player.

19. The method of claim 18, wherein the bonus prize is displayed after the player selects one bonus prize display.

20. The method of claim 18, further comprising causing at least one bonus prize display that was not selected by the player to display a second bonus prize.

21. A gaming device, comprising:

(A) a plurality of bonus prize display means for displaying bonus prizes;

(B) indicator means for indicating at least two of the plurality of bonus prize display means and less than all of the plurality of bonus prize display means, the indicator means comprising a physical moveable indicator;

(C) selector means for allowing a player to select at least one of the indicated bonus prize display means;

(D) means for selecting the at least two bonus prize display means;

(E) means for causing the indicator means to indicate the at least two bonus prize display means;

(F) means for determining a bonus prize;

(G) means for detecting the bonus prize display means selected by the player; and (H) means for displaying the bonus prize on the bonus prize display means selected by the player.

22. The gaming device of claim 21, further comprising a drive means for causing the indicator means to move.

23. A gaming system, comprising:

(A) at least one game apparatus, the game apparatus comprising:

(a) at least one gaming outcome display positioned to be visible to a player, the gaming outcome display being configured to display an outcome of a game; and (b) at least one game apparatus controller in communication with the gaming outcome display, the game apparatus controller being programmed to allow a player to play the game and cause the outcome of the game to be displayed on the gaming outcome display; and (B) at least one display device, the display device comprising:

(a) plurality of bonus sets positioned to be visible to the player, each bonus set comprising a plurality of bonus prize displays, each bonus prize display being configured to selectively display a plurality of different prizes;

(b) at least one indicator in close relative proximity to the plurality of bonus sets, the indicator being configured to indicate at least one of the plurality of bonus sets;

(c) at least one drive mechanism coupled to the indicator, the drive mechanism being configured to cause the indicator to move relative to the plurality of bonus sets and cause the indicator to indicate a selected bonus set by positioning the indicator;

(d) at least one selector, the selector being configured to allow the player to select one of the bonus prize displays from the selected bonus sets indicated by the indicator; and (e) at least one display device controller in communication with the game apparatus, each of the bonus prize displays, the drive mechanism, and the selector, the display device controller being configured to:

(i) randomly select a bonus set from the plurality of bonus sets;

(ii) cause the drive mechanism to position the indicator to indicate the selected bonus set;

(iii) detect the bonus prize display selected by the player;

(iv) randomly determine a prize; and (v) cause the bonus prize display selected by the player to display the randomly determined prize.

24. The gaming system of claim 23, wherein the bonus prize display is an LED meter.

25. The gaming system of claim 23, wherein the prize awarded to the player is not influenced by the bonus prize display selected by the player.

* * * * *